US008967753B2

(12) United States Patent
Suzuki et al.

(10) Patent No.: US 8,967,753 B2
(45) Date of Patent: Mar. 3, 2015

(54) IMAGE FORMING APPARATUS USING A PRE-PROCESSING LIQUID AND DRYING A PRINTING MEDIUM, AND IMAGE FORMING METHOD USING A PRE-PROCESSING LIQUID AND DRYING THE PRINTING MEDIUM

(71) Applicants: Yoshinari Suzuki, Atsugishi (JP); Yukihito Niino, Kawasakishi (JP); Kazuki Yasu, Sagamiharashi (JP)

(72) Inventors: Yoshinari Suzuki, Atsugishi (JP); Yukihito Niino, Kawasakishi (JP); Kazuki Yasu, Sagamiharashi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/875,116

(22) Filed: May 1, 2013

(65) Prior Publication Data

US 2013/0293617 A1 Nov. 7, 2013

(30) Foreign Application Priority Data

May 1, 2012 (JP) ..... 2012-104792
Apr. 24, 2013 (JP) ..... 2013-091159

(51) Int. Cl.

*B41J 29/38* (2006.01)
*B41J 2/01* (2006.01)
*B41J 11/00* (2006.01)
*B41J 15/04* (2006.01)

(52) U.S. Cl.

CPC ..... *B41J 11/0015* (2013.01); *B41J 11/002* (2013.01); *B41J 15/04* (2013.01)
USPC ..... 347/16; 347/102

(58) Field of Classification Search

None
See application file for complete search history.

(56) References Cited

U.S. PATENT DOCUMENTS

| | | | | |
|---|---|---|---|---|
| 6,585,363 | B1 | 7/2003 | Tanaka et al. | |
| 7,338,143 | B2 | 3/2008 | Onishi et al. | |
| 2011/0199448 | A1 * | 8/2011 | Kaiho et al. | 347/102 |

FOREIGN PATENT DOCUMENTS

| | | |
|---|---|---|
| JO | 07-156538 | 6/1995 |
| JP | 03-043825 | 2/1991 |
| JP | 2002-096454 | 4/2002 |
| JP | 2010-046844 | 3/2010 |
| JP | 2010-076316 | 4/2010 |
| JP | 2010-201711 | 9/2010 |
| JP | 2011-183336 | 9/2011 |

OTHER PUBLICATIONS

U.S. Appl. No. 13/874,849, fild May 1, 2013, Niino , et al.
U.S. Appl. No. 13/654,857, filed Oct. 18, 2012, Sunaoshi.

* cited by examiner

*Primary Examiner* — Geoffrey Mruk
(74) *Attorney, Agent, or Firm* — Oblon, Spivak, McClelland, Maier & Neustadt, L.L.P.

(57) ABSTRACT

An image forming apparatus including an image forming device that ejects the droplets onto a printing medium, and forms an image on a surface of the printing medium; a pre-processing device that applies a pre-processing liquid to the surface of the printing medium before the image forming device forms the image; and a dryer configured to dry the printing medium on which the pre-processing liquid was applied, wherein the pre-processing device applies on amount of the pre-processing liquid that is determined based on resolution of the image formed on the printing medium, and the dryer dries using a drying strength that is determined based on the resolution of the image formed on the printing medium.

8 Claims, 10 Drawing Sheets

IMAGE FORMING APPARATUS USING A PRE-PROCESSING LIQUID AND DRYING A PRINTING MEDIUM, AND IMAGE FORMING METHOD USING A PRE-PROCESSING LIQUID AND DRYING THE PRINTING MEDIUM

CROSS-REFERENCE TO RELATED APPLICATIONS

The present application claims priority under 35 U.S.C. §119(a) to Japanese Patent Application No. 2013-091159, filed Apr. 24, 2013 and Japanese Patent Application No. 2012-104792, filed May 1, 2012, the entire contents of which are incorporated herein by reference.

BACKGROUND

1. Field

Embodiments disclosed herein relate to an image forming apparatus and an image forming method.

2. Description of the Related Art

An inkjet image forming method has rapidly been adopted in recent years owing to an advantageous property that the method is easily enhanced for a method of forming color images, as well as properties that the method is noiseless and has a low running cost.

JP-A No. 2004-330568 discloses a pretreatment process of forming an ink receiving layer that aggregates colorant on paper of ink by applying the precoating liquid, an image forming process of jetting ink to the ink receiving layer, and a drying process of drying the precoating liquid by heating the paper near the ink receiving layer.

The most appropriate amount of the pre-processing liquid (precoating liquid) changes according to a printing condition, for example, the resolution of an image.

Using the technology disclosed in the above-described document, bleeding of the formed image or the contraction of the printing medium can occur.

SUMMARY

The embodiments disclosed herein have been developed in view of the above-described problems of conventional techniques.

An objective of the disclosed embodiments is to provide an image forming apparatus and an image formation method that can improve the quality of an image formed on a printing medium.

In one aspect, there is provided an image forming apparatus including an image forming device configured to eject droplets onto a printing medium, and to form an image on a surface of the printing medium; a pre-processing device configured to apply a pre-processing liquid to the surface of the printing medium before the image forming device forms the image; and a dryer configured to dry the printing medium on which the pre-processing liquid was applied, wherein the pre-processing device is configured to apply an amount of the pre-processing liquid that is determined based on a resolution of the image formed on the printing medium, and the dryer is configured to dry the printing medium using a drying strength that is determined based on the resolution of the image formed on the printing medium.

In another aspect, there is provided an image forming method including the steps of applying a pre-processing liquid to a surface of a printing medium; forming an image on the surface of the printing medium on which the pre-processing liquid was applied; and drying the printing medium on which the pre-processing liquid was applied, wherein the applying step includes applying an amount of the pre-processing liquid that is determined based on a resolution of the image formed on the printing medium, and drying the printing medium using a drying strength that is determined based on the resolution of the image formed on the printing medium.

According to the embodiments of the present invention, there are provided an image forming apparatus and an image formation method that can improve the quality of the printing medium on which the image is formed.

DETAILED DESCRIPTION

Hereinafter, one embodiment will be explained for an inkjet image forming apparatus. However, the present advancements can be also applied to any image forming apparatus having an ejecting unit (ejecting head, ink head, recording head, or the like) that forms (e.g., prints) an image on a printing medium by ejecting recording liquid droplets (e.g., ink) such as a facsimile device, a copier device, a multifunction peripheral, etc., otherwise than as specifically described herein.

A Configuration of an Image Forming Apparatus

The outline of an image forming apparatus 100 according to one embodiment is explained with reference to FIGS. 1 to 5.

Although this embodiment has been described using an image forming apparatus having ejecting heads (recording head, print heads, ink heads) of the four colors of black (K), cyan (C), magenta (M), and yellow (Y), the scope of the present advancements is not limited to the described image forming apparatus having these ejecting heads. The scope of the present advancements includes the image forming apparatus also having the ejecting heads of green (G) red (R), light cyan (LC), and/or other colors, and the image forming apparatus only having an ejecting head of black (K). In the following explanation, Y, C, M, and K represent colors of yellow, cyan, magenta, and black, respectively.

Although the present advancements have been described using a continuous form sheet in the form of a roll (hereinafter referred to as "roll sheet Md") as the printing medium, the printing medium that can be formed by the printing apparatus is not limited to the roll sheet. The printing medium that can be formed by the printing apparatus may also be a cut sheet. The scope of the printing medium that can be formed by the printing apparatus includes a medium that can form an image by liquid droplets on a surface such as standard paper, high quality paper, thick paper, thin paper, cut sheet, roll sheet, a OHP sheet, synthetic resin film, and metal thin film. The continuous form sheet includes perforated box paper or unperforated roll paper. A page of the box paper is, for example, between a first perforation and the next perforation.

Figure 1:
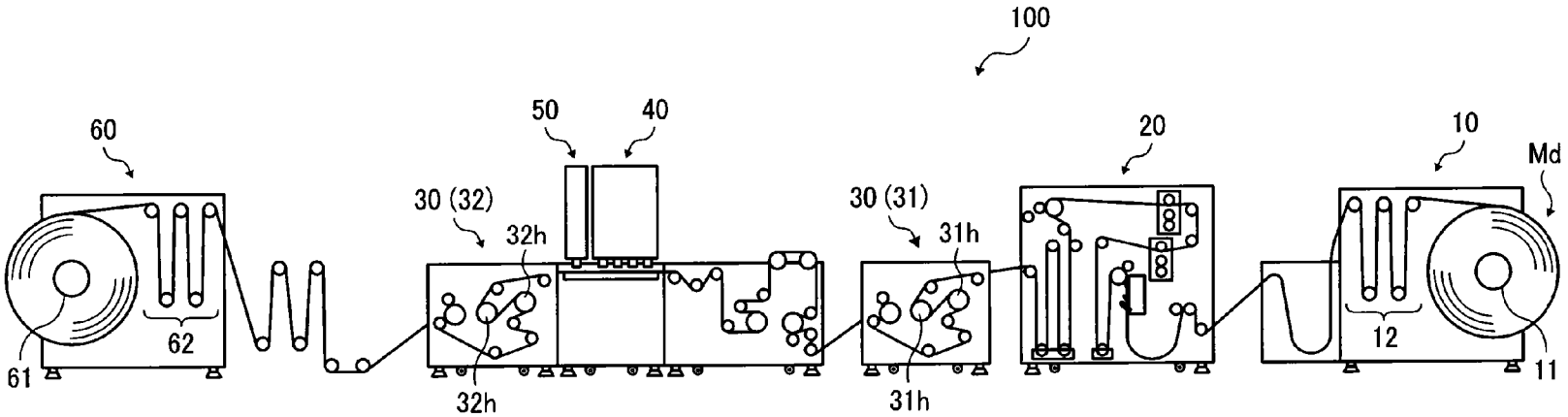
FIG. 1 is a schematic side view showing an example of an image forming apparatus.

As shown in FIG. 1, an image forming apparatus 100 according to an embodiment includes a sheet feeding unit 10 for feeding the roll sheet Md (printing medium), a pre-processing unit 20 for pre-processing the roll sheet Md that is fed by the sheet feeding unit 10, and a drying unit 31 for drying the roll sheet Md that was treated by the pre-processing unit 20. The image forming apparatus 100 includes an image forming unit 40 for forming an image on a surface of the roll sheet Md. Furthermore, as shown in FIG. 1 the image forming apparatus 100 may include a post-processing unit 50 for treating a post-processing to the roll sheet Md that formed an image by the image forming unit 40. Then, in some instances, the image forming apparatus 100 can include a drying unit 32 for drying the roll sheet Md that was treated by the post-processing unit 50. The image forming apparatus 100 includes a sheet discharging unit 60 for discharging the roll sheet Md on which the image was formed. (In some instances the roll sheet Md may be further treated by the post-processing unit 50.) Furthermore, the image forming apparatus 100 includes a controlling unit for controlling the action of the image forming apparatus 100.

The image forming apparatus 100 according to an embodiment feeds the roll sheet Md by the sheet feeding unit 10, treats pre-processing to the surface of the roll sheet Md by the pre-processing unit 20, and dries the surface of the roll sheet Md by the drying unit 31. The image forming apparatus 100 forms an image by the image forming unit 40 on the surface of the roll sheet Md that was treated by the pre-processing unit and dried. Furthermore, in some instances, the image forming apparatus 100 can perform post-processing by the post-processing unit 50 to the roll sheet Md on which an image is formed, and perform drying by the drying unit 32. Then, the image forming apparatus 100 rolls up (discharges) the roll sheet Md by the sheet discharging unit 60.

Hereinafter, each component of the image forming apparatus 100 will be concretely described.

A Configuration of the Sheet Feeding Unit

The sheet feeding unit 10 feeds a printing medium to the pre-processing unit 20. In this embodiment, the sheet feeding unit 10 includes a sheet holder 11 and plural conveyance rollers 12. The sheet feeding unit 10 conveys a roll sheet Md, which is held by the sheet holder 11, to the pre-processing unit 20 by the conveyance rollers 12.

Additionally, this embodiment is described with an example of using the roll sheet as a printing medium, but the present advancements can use other printing media, and in case of using other printing media, the sheet feeding unit 10 can include other configurations.

A Configuration of the Pre-Processing Unit

The pre-processing unit 20 treats a printing medium before the image processing unit 40 will form an image on the printing medium. In this embodiment, the pre-processing unit 20 treats a surface of the roll sheet Md that is conveyed by the feeding unit 10. The pre-processing unit 20 treats the surface by a pre-processing liquid.

The pre-processing process is a process of uniformly applying the pre-processing liquid to a surface of the roll sheet Md (printing medium). The pre-processing liquid has a function of aggregating a droplet of ink.

This enables the image forming apparatus 100 to apply a pre-processing liquid, which has a function of aggregating a droplet of ink to a surface of the printing medium before the image processing unit 40 will form an image on the printing medium, in case the image forming apparatus 100 forms an image on a printing medium different from a sheet for inkjet. This enables the image forming apparatus 100 to reduce problems, such as bleeding of the image, a problem of image density, a problem of image tone, an ink strike-through problem, a problem of water resistance, or a problem of environment resistance. That is, the image forming apparatus 100 can improve the quality of an image that is formed on the printing medium, by applying the pre-processing liquid, which has a function of aggregating a droplet of ink to the printing medium by the pre-processing unit 20 before the image forming unit 40 will form the image on the printing medium.

Additionally, the image forming apparatus 100 may apply the pre-processing liquid, which has a function of aggregating a droplet of ink to the sheet for inkjet by the pre-processing unit 20, before the image forming unit 40 will form the image on the sheet for inkjet.

The pre-processing method by the pre-processing unit 20 according to one embodiment is not restricted, and can be selected appropriately according to the object, and examples of the method for applying include a blade coating method, a gravure coating method, a gravure offset coating method, a bar coating method, a roll coating method, a knife coating method, an air knife coating method, a comma coating method, a U-comma coating method, an AKKU coating method, a smoothing coating method, a micro gravure coating method, a reverse roll coating method, a 4-roll or 5-roll coating method, a dip coating method, a curtain coating method, a slide coating method, and a die coating method.

The pre-processing unit 20 according to one embodiment can use a treating liquid that includes water-soluble aliphatic amino acids as the pre-processing liquid. The treating liquid that includes water-soluble aliphatic amino acids has a behavior of aggregating a water-dispersible colorant, which means converging each of the water-dispersible colorant particles.

Furthermore, the pre-processing unit 20 can adsorb ions onto the surface of the water-dispersible colorant by adding an ionic object, such as water-soluble aliphatic amino acids, in the pre-processing liquid. This enables the pre-processing unit 20 to neutralize the surface charge of the water-dispersible colorant. This also enables the pre-processing unit 20 to aggregate more of the water-dispersible colorant by increasing the aggregate by the force between the molecules.

An embodiment of a pre-processing unit 20 using a roll coating method will be described with reference to FIG. 2.

Figure 2:
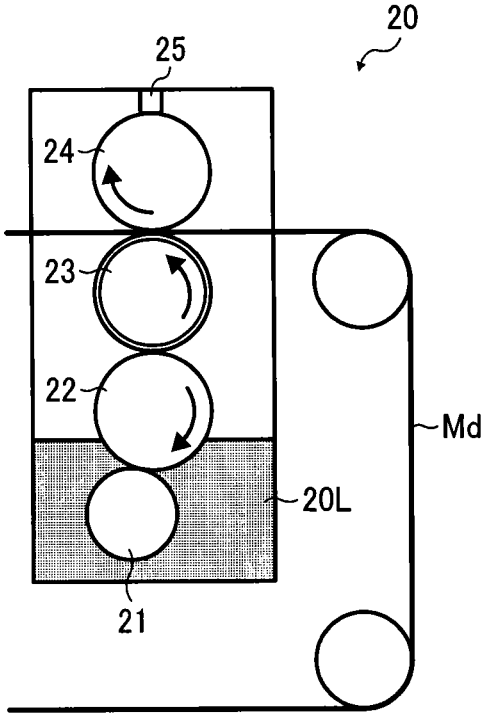
FIG. 2 is a schematic configuration view showing an example of a pre-processing unit of an image forming apparatus.

As shown in FIG. 2, the pre-processing unit 20 applies a pre-processing liquid 20L, which is stored in the pre-processing unit 20, to a surface of the roll sheet Md that is conveyed (fed) to the pre-processing unit 20 by the feeding unit 10 (FIG. 1).

Specifically, a stirring roller 21 and a transferring roller 22 form the pre-processing liquid 20L as a thin film to a surface of an applying roller first. Next, the pre-processing unit 20 presses the applying roller 23 onto a platen roller 24, and rotates the applying roller 23. In this state, the pre-processing unit 20 conveys the roll sheet Md between the applying roller 23 and the platen roller 24. This enables the pre-processing liquid not to be applied to a surface of the roll sheet Md.

A pressure controller 25 of the pre-processing unit 20 controls the nip pressure between the applying roller 23 and the platen roller 24 at a time that the pre-processing unit applies the pre-processing liquid 20L. The nip pressure is a force acting on a position of contact between the applying roller 23 and the platen roller 24. The pre-processing unit 20 can control (change) the amount of the pre-processing liquid applied to the roll sheet Md by controlling (changing) the nip pressure by the pressure controller 25. The applied amount of the pre-processing liquid includes the amount of liquid, the amount of applying, the amount of liquid after drying, and the thickness of the liquid film.

Furthermore, the pre-processing unit 20 controls the rotation speed of the applying roller 23 and the platen roller 24. The pre-processing unit can control (change) the applied amount of the pre-processing liquid by controlling (changing) the rotation speed of the applying roller 23 and the platen roller 24. Additionally, the pre-processing unit 20 may control the applying unit 23 and/or the platen roller 24 by controlling the power source (motor or the like) to drive the applying unit 23 and/or the platen roller 24.

Accordingly, the pre-processing unit 20 of the image forming apparatus according to an embodiment using the roll coating method can more uniformly apply the pre-processing liquid to a surface of the roll sheet Md (printing medium) than using the spray coating method. The pre-processing unit 20 of this embodiment can uniformly and thinly apply the pre-processing liquid 20L to a surface of the roll sheet Md when the pre-processing liquid 20L has a high viscosity. The pre-processing unit 20 enables the image that will form after the pre-processing method to have reduced image bleeding by uniformly and thinly applying the pre-processing liquid 20L to the roll sheet Md. This enables improved image quality.

The pre-processing unit 20 of the image forming apparatus according to this embodiment can apply an amount of the pre-processing liquid 20L suitable for the image forming method and post-processing method to the roll sheet Md (printing medium) by controlling the amount of the pre-processing liquid by the applying roller 23 and/or the platen roller 24.

A Configuration of the Drying Unit

The drying unit 30 is the unit to dry the printing medium by heating, etc. The drying unit 30 in this embodiment includes the pre-processing liquid drying unit 31, which dries the roll sheet Md that was treated by the pre-processing unit 20. The drying unit 30 can include the post-processing liquid drying unit 32, which dries the roll sheet Md that was treated by the post-processing unit 50. The post-processing liquid drying unit 32 may not be needed in some embodiments.

As shown in FIG. 1, the pre-processing liquid drying unit 31 of this embodiment uses plural heating rollers 31*h*. Specifically, the heating roller 31*h* is heated from 40 degree C. to 80 degrees C., and a surface of the roll sheet Md to which the pre-processing liquid 20L was applied contacts the heating roller 31*h*. This enables the pre-processing liquid drying unit 31 to dry the roll sheet Md (the pre-processing liquid on the roll sheet Md) by evaporating the water in the pre-processing liquid by heating the surface of the roll sheet Md by the heating roller 31*h*.

Additionally, the number of the heating rollers 31 in the drying unit 30 is not limited to that shown in FIG. 1, and can be changed as needed.

The pre-processing liquid drying unit 31 is not limited to include the heating roller as a drying method. That is, the pre-processing liquid drying unit 31 can use any drying method, such as an infrared ray drying method, a microwave drying method, or a hot-air drying method. The pre-processing liquid drying unit 31 can also use plural methods in combination.

A description of the configuration of the post-processing liquid drying unit will be omitted because it is similar to the pre-processing liquid drying unit.

A Configuration of the Image Forming Unit

The image forming unit 40 is a unit for forming an image on a printing medium. The image forming unit 40 of this embodiment forms an image on a surface of the roll sheet Md by ejecting the recording liquid droplets (e.g., ink) on the roll sheet Md that was dried by the drying unit 30.

Figure 3:
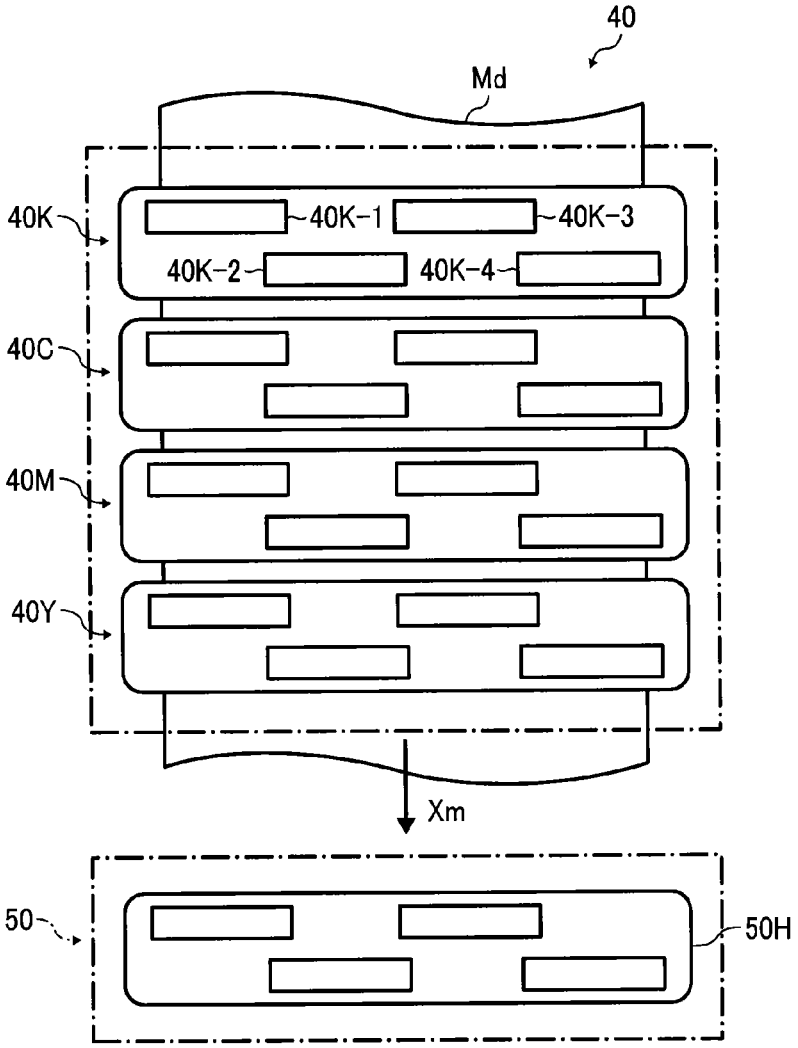
FIG. 3 is a schematic plan view showing an example of an image forming unit and a post-processing unit of an image forming apparatus.
Figure 4:
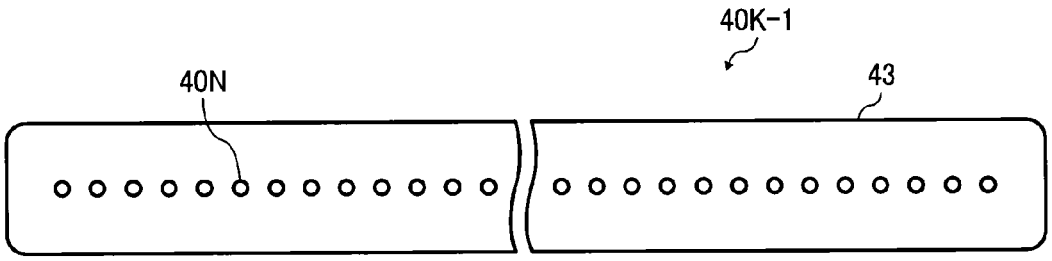
FIG. 4 is a schematic plan view showing an example of a head unit of an ejecting head for ejecting the black color ink of an image forming unit.

An example of an external shape of the image forming unit 40 will be described with reference to FIGS. 3 and 4. FIG. 3 is a schematic plan view showing an example of the image forming unit 40 and a post-processing unit 50 of the image forming apparatus 100 according to this embodiment. FIG. 4 is a schematic plan view showing an example of a head unit of an ejecting head for ejecting the black color ink of the image forming unit 40.

As shown in FIG. 3, the image forming unit 40 can use full-line heads. That is, the image forming unit 40 includes four ejecting heads 40K, 40C, 40M, and 40Y for different colors, black (K), cyan (C), magenta (M), and yellow (Y), in this order from the upstream to the downstream in a printing medium conveyance direction Xm.

The ejecting head 40K for ejecting the black (K) color ink includes four head units 40K-1, 40K-2, 40K-3, and 40K-4, which are arranged in a staggered manner in the direction perpendicular to the printing medium conveyance direction Xm. This enables the image forming apparatus 40 to form an image in the whole width of the image forming range (printing range) of the roll sheet Md (printing medium). A description of the configuration of the other ejecting heads 40C, 40M, and 40Y will be omitted since they are similar to the ejecting head 40K.

FIG. 4 is an enlarged plan view showing a head unit 40K-1 of the ejecting head 40K for ejecting the black color ink of the image forming unit 40.

As shown in FIG. 4, the head unit 40K-1 has plural eject openings 40N (nozzles, printing nozzles) on the nozzle face. The plural eject openings 40N are arranged along a longitudinal direction of the head unit 40K-1, and form the nozzle array. Additionally, the head unit 40K-1 may have plural nozzle arrays.

Figure 5:
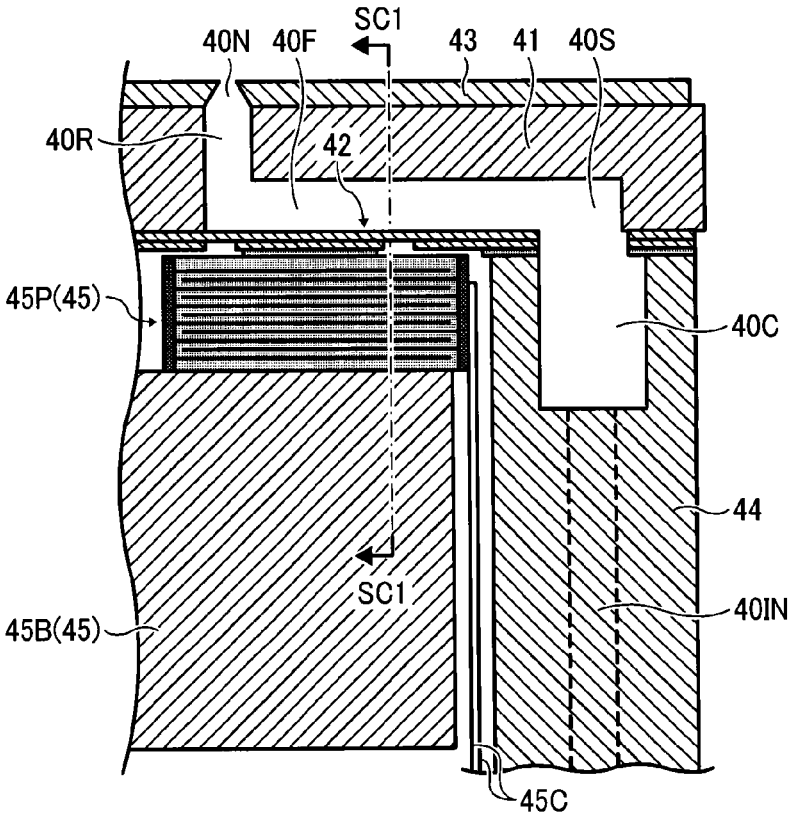
FIG. 5 is a cross sectional view showing an example of a cross section shown along a longitudinal direction of a liquid chamber.
Figure 6:
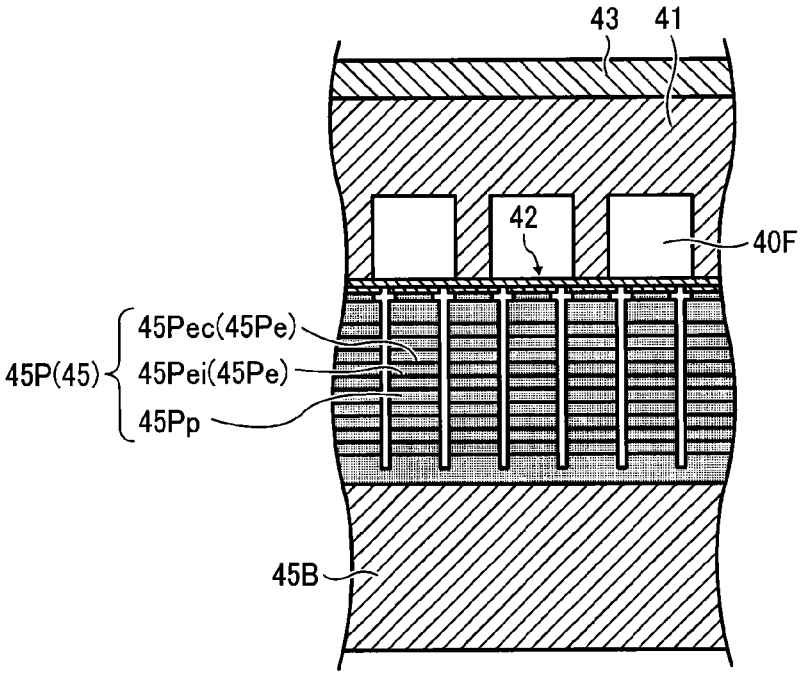
FIG. 6 is a cross sectional view showing an example of a cross section shown along a lateral directions of the liquid chamber.

A cross-sectional view showing the ejecting head of the image forming unit 40 will be described with reference to FIGS. 5 and 6. FIG. 5 is a cross-sectional view showing an example of the ejecting head in the longitudinal direction of a liquid chamber 40F of the image forming unit 40. FIG. 6 is a cross-sectional view showing the ejecting head in the lateral direction (nozzle sequence direction) of the liquid chamber 40F of the image forming unit 40. FIG. 6 is a cross-sectional view when viewed along a line SC1 in FIG. 5.

As shown in FIG. 5, the ejecting head is configured with a nozzle communication channel 40R that is a flow channel communicating with a nozzle 40N for ejecting a recording liquid droplet (ink droplet) and provided by jointing and stacking a flow channel plate 41 that is formed, for example, by anisotropically etching a single crystal silicon substrate, a vibrating plate 42, which is jointed to the lower surface of the channel plate 41 and formed by means of, for example, nickel electroforming, and a nozzle plate 43 jointed to the top surface of the flow channel plate 41, a liquid chamber 40F that is a pressure generating chamber, an ink supplying port 40S that is provided for supplying ink to the liquid chamber 40F through a fluid resistance part (supplying channel) and communicating with a common liquid chamber 40C, and the like.

Also, there are provided two lines of laminated-type piezoelectric elements 45P as electromechanical elements that are pressure generating devices 45 (actuator devices) for pressurizing ink in the liquid chamber 40F by deforming the vibrating plate 42, and a base substrate 45B for jointing and fixing the piezoelectric elements 45P.

Additionally, supporting pillar parts are provided between the piezoelectric elements 45P.

The supporting pillar parts are parts that are formed together with the piezoelectric elements 45P by dividing and processing a piezoelectric member, but are simple supporting pillars since no driving voltage is applied thereon.

Also, FPC cables 45C on which a driving circuit (driving IC) is mounted are connected to the piezoelectric elements 45P.

Then, the peripheral portion of the vibrating plate 42 is connected to a frame member 44, and recesses provided for a perforation part for accommodating an actuator unit composed of the piezoelectric elements 45P, the base substrate 45B and the like and the common liquid chamber 40C and an ink supply port 40IN for supplying ink from the outside to the common liquid chamber 40C are formed on the frame member 44.

The frame member 44 is formed by means of injection molding of, for example, a thermosetting resin, such as epoxy-type resins or a poly(phenylene sulphite).

Herein, the flow channel plate 41 is provided by forming recesses and holes that are provided for the nozzle communication channel 40R and the liquid chamber 40F by, for example, anisotropically etching a single crystal silicon substrate with a crystallographic orientation (110) using an alkaline etching liquid such as an aqueous solution of potassium hydroxide (KOH). However, it is not limited to the single crystal silicon substrate and others, such as a stainless substrate and photosensitive resins, may also be used.

The vibrating plate 42 is formed from a metal plate of nickel and fabricated by, for example, an electroforming method (electrocasting method), although other metal plates, jointing members of a metal and resin plates, and the like may also be used. The piezoelectric elements 45P and the supporting pillar parts are jointed to the vibrating plate 42 with a bonding material and the frame member 44 is further jointed with a bonding material.

The nozzle plate 43 includes a nozzle with a diameter of 10-30 μm, which is formed so as to correspond to each liquid chamber 40F, and is jointed to the flow channel plate 41 with a bonding material.

The nozzle plate 43 includes a water-repellent layer formed on the top surface of a desired layer on the surface of a nozzle forming member made of a metal member.

As shown in FIG. 6, the piezoelectric element 45P is a laminated-type piezoelectric element (herein, a PZT) provided by laminating piezoelectric materials 45Pp and internal electrodes 45Pe alternately.

A separate electrode 45Pei and a common electrode 45Pec are connected to each of internal electrodes 45Pe, which are alternately led to the different end faces of the piezoelectric element 45P.

Additionally, in this embodiment, there is provided a configuration such that ink in the liquid chamber 40F is pressurized by using a deformation of the piezoelectric element 45P in directions of d33 as directions of piezoelectricity, but there may also be provided a configuration such that ink in the pressurized liquid chamber 40F is pressurized by using a deformation of the piezoelectric element 45P in directions of d31 as directions of piezoelectricity.

Also, there may also be provided a configuration such that one line of piezoelectric elements 45P is provided on one substrate 45B.

In a thus-configured liquid ejecting head, for example, when a voltage applied to the piezoelectric element 45P is lower relative to a reference electric potential, the piezoelectric element 45P is contracted and the vibrating plate 42 is lowered so as to increase the volume of the liquid chamber 40F, whereby ink flows into the liquid chamber 40F. Subsequently, the voltage applied to the piezoelectric element 45P is increased so that the piezoelectric element 45P extends in the directions of lamination, and the vibrating plate 42 is deformed toward the direction of the nozzle 40N so as to decrease the volume of the liquid chamber 40F. Thereby, recording liquid (ink) in the liquid chamber 40F is pressurized so as to eject (jet) a drop of recording liquid (ink) from the nozzle 40N.

Then, when the voltage applied to the piezoelectric element 45P is set back to the reference electric potential, the vibrating plate 42 is restored to the initial state and the liquid chamber 40F expands so as to generate a negative pressure. Then, the inside of the liquid chamber 40F is filled with recording liquid (ink) from the common liquid chamber 40C.

Then, after the vibration of a meniscus surface at the nozzle 40N damps and is stabilized, transition to an operation for the next liquid drop ejection is made.

Additionally, the method for driving the head is not limited to the above example (pull-push-ejection), but pull-ejection or push-ejection may also be conducted depending on a method for providing a driving wave pattern.

Accordingly, the image forming apparatus 100 accordingly to this embodiment can form a full-color image or a monochrome image along the whole width of the image-forming range by the image forming unit 40 (the ejecting units 40K, 40C, 40M, and 40Y) during a single conveyance of the printing medium (roll sheet Md).

Additionally, the pressure generating device 45 is not limited to the above example (the piezoelectric element 45P). That is, the pressure generating device 45 may include, for example, a thermal actuator including an electrothermal converter element, such as a heating resistor or the like applying a phase change in a liquid by film boiling, a shape memory alloy actuator applying metallic phase change by a temperature variation, and an electrostatic actuator applying electrostatic force generating a pressure for jetting a liquid droplet.

A Configuration of the Post-Processing Apparatus

The post-processing unit 50 is a unit for treating the printing medium on which an image was formed. The post-processing unit 50 may not be needed in some embodiments.

In this embodiment, the post-processing unit 50 treats a surface of the roll sheet Md on which an image was formed by the image forming unit 40. The post-processing unit 50 treats the surface by a post-processing liquid.

As shown in FIG. 3, the post-processing unit 50 in this embodiment is arranged downstream from the image forming unit 40 in a printing medium conveyance direction Xm. The post-processing unit 50 includes post-processing head units 50H, which are arranged in a staggered manner in the direction perpendicular to the printing medium conveyance direction. Furthermore, the post-processing unit 50 controls the amount of ejecting (applying) of the post-processing liquid by controlling a driving wave pattern inputting to the post-processing head units 50H. This enables the post-processing unit 50 to eject (apply) the post-processing liquid to the whole width of the image forming range (printing range) of the roll sheet Md (printing medium). A description of the configuration of post-processing head unit 50H will be omitted as it is similar to the configuration of the image forming unit 40 (FIGS. 3 to 6).

Figure 7:
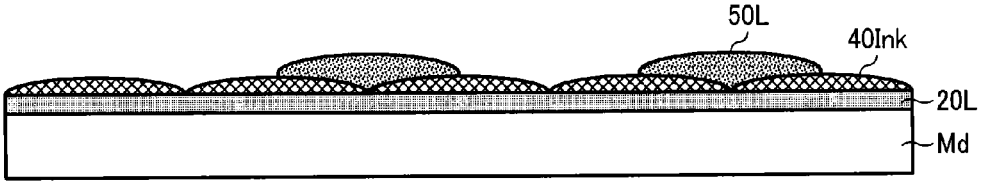
FIG. 7 is an illustration showing of an example of the printing medium on which the image is formed by an image forming apparatus.

The post-processing is a process of ejecting (depositing) the post-processing liquid onto the roll sheet Md (printing medium). The post-processing liquid is deposited in the shape of dots or stripes. This enables improvement of the abrasion resistance, glossiness, and preservation stability (the environment resistance, the water resistance, and the gas resistance, or the like) of the printing medium on which the image was formed. As shown in FIG. 7, when the post-processing unit starts the post-processing, a surface of the roll sheet Md was applied with the pre-processing liquid 20L and the ink 40Ink for forming an image was ejected onto the surface. The post-processing unit 50 of the image forming apparatus 100 according to this embodiment performs the process of ejecting (depositing) the post-processing liquid 50L onto the roll sheet Md on which the image was formed.

Furthermore, the post-processing unit 50 of the image forming apparatus 100 according to this embodiment can eject the post-processing liquid 50L to a smaller area than the surface area on which the pre-processing liquid 20L was applied. The post-processing unit 50 of the image forming apparatus 100 according to this embodiment can eject the post-processing liquid 50L to a smaller area than the surface area on which the image is formed.

That is, the post-processing liquid 50L is ejected (deposited) to a smaller area than the surface area of applying of the pre-processing liquid 20L. In FIG. 7, the ink 40Ink is ejected to the entire area, and the post-processing liquid 50L is ejected (deposited) to a smaller area than the entire area.

Additionally, FIG. 7 shows that the post-processing liquid 50L is formed in the shape of dots. However, the post-processing liquid may be formed in the shape of stripes in a direction perpendicular to the cross section.

As shown in FIG. 7, this embodiment requires that the post-processing liquid 50L be ejected (deposited) to a smaller area than the surface area on which an image is formed. The post-processing liquid 50L may be ejected (deposited) to the area on which an image is not formed or may not be ejected (deposited) to the area on which an image is not formed.

In case that the printing medium that is formed to the shape in FIG. 7 is scraped against an object, a surface part of a layer of the post-processing liquid 50L is scraped against the object. The post-processing liquid 50L prevents not only the ink 40Ink of the area on which the post-processing liquid 50L is ejected from peeling off, but also the ink 40Ink of the area on which the post-processing liquid 50L is not ejected from peeling off, because the layer of the post-processing liquid 50L has a certain thickness.

Accordingly, the image forming apparatus 100 according to an embodiment can eject (deposit) the post-processing liquid 50L by the post-processing unit 50 to the printing apparatus (roll sheet Md) on which an image was formed. This enables the image forming apparatus 100 according to this embodiment to prevent the image (ink) printed on the printing medium (roll sheet Md) from peeling off by being scraped against an object (e.g., another printing medium), compared to when the post-processing liquid is not ejected (not deposited). That is, the image forming apparatus 100 can improve the abrasion resistance of the image to be formed on the printing medium by using the post-processing unit 50.

Then, the image forming apparatus 100 can improve the quality of an image to be formed on the printing medium, because the post-processing unit 50 can deposit (eject) the post-processing liquid 50L onto the printing medium (roll sheet Md) on which an image was formed. That is, the image forming apparatus 100 can reduce problems such as bleeding of the image, a problem of image density, a problem of image tone, an ink strike-through problem, a problem of water resistance, or a problem of environment resistance, because the post-processing unit 50 can deposit (eject) the post-processing liquid 50L onto the printing medium on which an image was formed.

The post-processing unit 50 of the image forming apparatus 100 according to this embodiment preferably ejects (deposits) onto an area of the roll sheet Md on which an image was formed, as the post-processing method. Furthermore, the post-processing unit 50 preferably changes the amount of ejecting of the post-processing liquid 50L and/or the method of ejecting, based on the type and/or the penetrability and/or the glossiness of the printing medium, and/or the type of the printing medium, and/or the amount of applied pre-processing liquid by the pre-processing unit 20.

The post-processing unit 50 according to this embodiment can eject the post-processing liquid in a desired amount, to the shape of dots as desired, or to the shape of stripes as desired, to a desired area.

Specifically, the post-processing unit 50 can eject any area described as follows. The post processing unit 50 can eject to the area available for image forming. The post processing unit 50 can eject to the area on which an image was formed. The post processing unit 50 can eject to the area on which the ink droplets were ejected. The post-processing unit 50 can also eject to a slightly (1 dot or 2 dots) larger area than the area of the roll sheet Md (printing medium) on which an image was formed. Furthermore, the post-processing unit can eject to a percentage N of the selected area (as the shape of dots or stripes).

The percentage N may be from 5 percent to 50 percent. The percentage N may be decided by experiment or numerical calculations.

The post-processing unit 50 can decide the area of ejecting by using any decision method described as follows. The post-processing unit 50 can decide based on the coverage rate of printing. The post-processing unit 50 can decide based on the amount of ejecting of the post-processing liquid 50L. The post-processing unit 50 may also decide that first the post-processing unit calculate the amount of ejecting of the post-processing liquid or the coverage rate of printing based on inputted information (printing image data or the like), and then the post-processing unit 50 decide based on the amount of the post-processing liquid ejected or the coverage rate of printing.

Accordingly, the post-processing unit 50 of the image forming apparatus according to an embodiment can eject (deposit) to an area related to the area on which an image was formed. This enables the image forming apparatus 100 according to this embodiment to shorten the time of post-processing and drying of the post-processing liquid. The image forming apparatus 100 according to this embodiment can reduce the amount of post-processing liquid compared to when the post-processing liquid is applied (ejected) to the entire surface of the printing medium. Furthermore, the image forming apparatus 100 according to this embodiment can reduce the cost of post-processing by reducing the amount of post-processing liquid compared to when the post-processing liquid is applied (ejected) to the entire surface of the printing medium.

Additionally, the post-processing method of the post-processing unit 50 is not particularly limited, and can be appropriately selected according to the type of post-processing liquid. The post-processing method of the post-processing unit 50 can be the pre-processing method of the pre-processing unit 20 or the ink ejecting method of the image processing unit 40. Furthermore, from the viewpoint of downsizing of the image forming apparatus and the viewpoint of the storage stability of the post-processing liquid, the post-processing method of the post-processing unit 50 is preferably the same method of the ink ejecting method of the image forming unit. In case of ejecting the post-processing liquid, the post-processing liquid preferably includes a water-soluble organic solvent. The water-soluble organic solvent may include a wetting agent. The wetting agent is added for the purpose of preventing clogging in a nozzle of an ejecting head, which is caused by the drying of the recording liquid (ink) in the ink ejecting method of the image forming unit 40.

The amount of the post-processing liquid on the roll sheet Md after drying is preferably from 0.5 g/m2 to 10 g/m2. The amount of the post-processing liquid on the roll sheet Md after drying is more preferably from 2 g/m2 to 10 g/m2. Additionally, in case that the amount of the post-processing liquid on the roll sheet Md after drying is less than 0.5 g/m2, the quality of the image (the abrasion resistance, glossiness, and preservation stability (the environment resistance, the water resistance, and the gas resistance, or the like)) may be reduced. In case that the amount of the post-processing liquid on the roll sheet Md after drying is more than 10 g/m2, the drying characteristics of the layer of the post-processing liquid (a protective layer) may be reduced because it may take a long time to dry. Furthermore, in case that the amount of the post-processing liquid on the roll sheet Md after drying is more than 10 g/m2, the quality of the image may be not improved any further, which may be economically unfavorable.

The post-processing unit 50 according to this embodiment can use a treating liquid that includes a material forming a clear protective layer on the roll sheet Md (printing medium) as the post-processing liquid. The treating liquid that includes a material forming a clear protective layer includes a water-based resin (a water-soluble resin or a water-dispersible resin), the water-soluble organic solvent (a wetting agent), a penetrating agent, a surfactant, water, and/or other components. The post-processing liquid may be an ultraviolet curing resin composition and/or a thermoplastic resin composition. Furthermore, for improving the glossiness and the fixability, the post-processing liquid is preferably a thermoplastic resin emulsion. This enables the post-processing unit 50 to improve the glossiness of a surface of the roll sheet Md on which an image was formed, or to protect the surface of the roll sheet Md by the resin layer, based on the method of the ejecting (applying).

Any type of water-based resin may be used depending on the desired purpose. For example, the following water-based resins may be used: acrylic resin, styrene-acrylic resin, urethane resin, acrylic silicone resin, and a fluorine resin. The contained amount of the water-based resin in the protective layer is preferably from 1% by mass to 50% by mass. Furthermore, in case of ejecting the post-processing liquid from the ejecting head, the contained amount of the water-based resin in the protective layer is preferably from 1% by mass to 30% by mass. Additionally, in case that the contained amount of the water-based resin is greater than the 50% by mass, viscosity of the post-processing liquid may be too high. In case that the contained amount of the water-based resin is less than the 1% by mass, the energy of the post-processing unit for drying the water in the post-processing liquid may increase.

The average particle diameter of the water-based resin in the post-processing liquid relates to the viscosity of the post-processing liquid. In case of the same composition, the average particle is smaller and the viscosity is greater. Accordingly, for preventing too great a viscosity of the post-processing liquid, the average particle diameter of the water-based resin is preferably larger than the 50 nm.

In case that the average particle diameter of the water-based resin in the post-processing liquid is tens of nanometers, the average particle diameter may be larger than the nozzle diameter. The average particle diameter is preferably smaller than the nozzle diameter (a diameter of the eject opening 40N in FIG. 3). Even though the average particle diameter of the water-based resin in the post-processing liquid is smaller than the diameter of the nozzle, in case of including the large diameter particle, the ability of ejecting may be deteriorated.

Accordingly, the average particle diameter of the water-based resin in the post-processing liquid is preferably smaller than 200 nm, more preferably smaller than 150 nm.

In case of using the water-soluble organic solvent (a wetting agent), the contained amount of the water-soluble organic solvent in the post-processing liquid is not particularly limited. The contained amount of the water-soluble organic solvent may be from 10% by mass to 80% by mass. The contained amount of the water soluble organic solvent is preferably from 15% by mass to 60% by mass. The water-soluble organic solvent (a wetting agent) is for example, 1,3-butadiene, glycerin, or the like.

Additionally, in case that the contained amount of the water-soluble organic solvent is greater than 80% by mass, the drying characteristics of the post-processing liquid on the printing medium may be deteriorated. In case that the contained amount of the water-soluble organic solvent is less than 10% by mass, the components of the post-processing liquid may be changed by mixing with the pre-processing liquid.

Penetrating agent and surfactant is not limited. The penetrating agent is, for example, 2-ethyl-1,3-hexanediol or the like. The surfactant is, for example, polyethylene oxide end-capped with perfluoroalkyl or the like. As the penetrating agent and the surfactant by using the post-processing unit 50, penetrating agent and surfactant of including the pre-processing liquid using by the pre-processing unit 20 or the ink using by the image forming unit 40 can be arbitrarily selected.

Additionally, the post-processing liquid may include other components. The post-processing liquid may include, for example, wax, pH adjuster, antimicrobial agent, surface modifier, or antiforming agent.

The wax is for example, polyethylene wax or the like. The pH adjuster is for example, 2-amino-2-ethyl-1,3-propanediol or the like. The antimicrobial agent is for example, 1,2-benzothiazolyl-3-one or the like. The surface modifier is, for example, polyether modified poly-dimethyl-siloxane (BYK-Chemie) or the like. The antiforming agent is for example, 2,4,7,9-Tetramethyl-4,7-decanediol or the like.

A Configuration of the Sheet Discharging Unit

The sheet discharging unit 60 is a unit of discharging the printing medium on which an image was formed. As shown in FIG. 1, the sheet discharging unit 60 of this embodiment includes a sheet holder 61 and plural conveyance rollers 62. The sheet discharging unit 60 using the conveyance rollers rolls up the roll sheet Md in the roller of the sheet holder.

Additionally, this embodiment has been described with an example of using the roll sheet as a printing medium, but other embodiments can use other printing media, and in case of using other printing media, the sheet discharging unit 60 can include other configurations.

Additionally, in case that the pressure to the roll sheet Md is high when the roll sheet Md is rolled up in the roller of the sheet holder 62, a drying unit for drying the roll sheet Md may be disposed adjacent to the entrance of the sheet holder 62, for preventing transfer of an image to the reverse side of the sheet.

A Configuration of the Controlling Unit

The controlling unit 70 is a unit for controlling the action of the image forming apparatus 100. The controlling unit of this embodiment instructs each component in the image forming apparatus 100, and controls the action of each component. The controlling unit 70 according to this embodiment will be described with reference to FIGS. 8 to 12.

Additionally, the image processing unit 100 may be a production printing system. The production printing system is a printing system able to print (form of image) a large volume of printing matter (document) in a short period of time, by efficiently controlling the job or the printing image data. Specifically, the image forming apparatus 100 (the controlling unit) according to this embodiment includes plural apparatuses. An apparatus controls the order of the printing job data, or transforms the printing job data to the raster image data (RIP process). The other apparatus performs printing based on the raster image data.

The image forming apparatus 100 (controlling unit 70) constructs a workflow system for managing production of printing job data to distribute the printing matter. That is, the image forming apparatus 100 (controlling unit 70) can more quickly process the workflow by distributing the process among the plural apparatuses.

Figure 8:
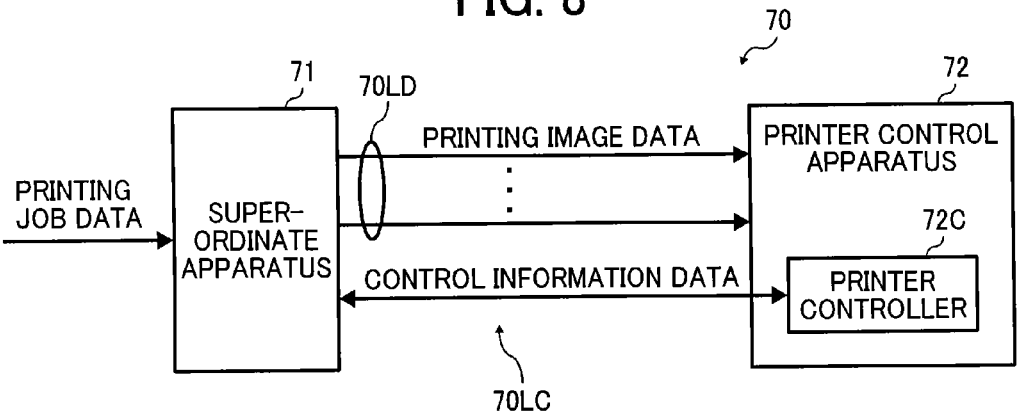
FIG. 8 is a schematic configuration view showing an example of a controlling unit of an image forming apparatus.

As shown in FIG. 8, the controlling unit 70 of the image forming apparatus 100 according to this embodiment includes a superordinate apparatus 71 (DFE, Digital Front End, RIP apparatus, raster image processor, or the like) and a printer control apparatus 72. The superordinate apparatus 71 produces the raster image data (RIP process), for example. The printer control apparatus 72 is included in a printing apparatus for printing. The superordinate apparatus 71 and the printer control apparatus 72 are connected via plural data lines 7OLD and plural control lines 70LC.

The superordinate apparatus 71 and the printer control apparatus 72 of the controlling unit 70 according to this embodiment will be explained below.

The Superordinate Apparatus

The superordinate apparatus 71 is an apparatus that produces the raster image data (RIP process) based on the printing job data (printing data, job data, or the like) that is received from the host apparatus. That is, the superordinate apparatus 71 produces the raster image data (hereinafter referred to as printing image data) corresponding to the ink colors, based on the printing data. The printing image data includes the data relating to ejecting of the post-processing liquid by the post-processing unit 50 (hereinafter referred to as the post-processing liquid image data).

The superordinate apparatus 71 produces the data for controlling the printing action (hereinafter referred to as control information data), based on the printing job data or the information of the host apparatus. The control information data include the type of printing, the form of printing, the information of the feeding and discharging of the sheet, the order of a surface of the printing, the size of the sheet for printing, the size of the data of the printing image data, the resolution, the type of the sheet, the tonal range, the information of the color, the number of the page, etc. The control information data includes the data of the ejecting of the post-processing liquid that is ejected by the post-processing unit 50 (hereinafter referred to as the post-processing control data).

Figure 9:
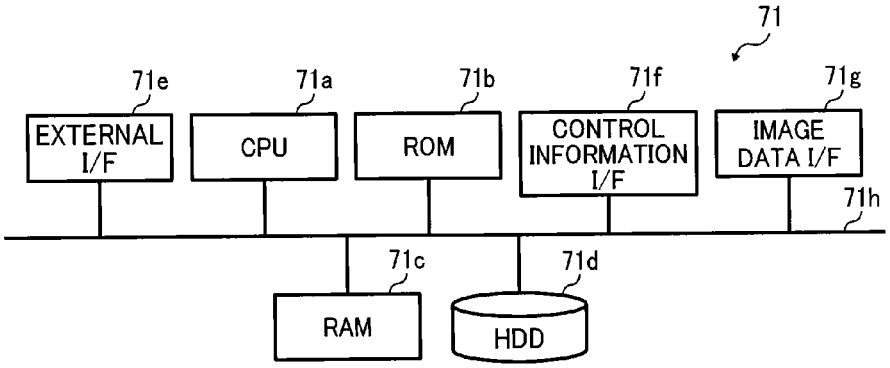
FIG. 9 is a schematic configuration view showing of an example of a superordinate apparatus of a controlling unit.

As shown in FIG. 9, the superordinate apparatus of this embodiment includes the CPU (Central Processing Unit) 71*a*, ROM (Read Only Memory) 71*b*, RAM (Random Access Memory) 71*c*, and HDD (Hard Disk Drive) 71*d*. The superordinate apparatus 71 also includes an external interface 71*e*, a control information interface 71*f*, and an image data interface 71*g*. Moreover, the superordinate apparatus 71 includes a bus 71*h* that connects to the CPU 71*a*, etc. That is, the CPU 71*a*, etc. in the superordinate apparatus 71 can communicate via the bus 71*h*.

The CPU 71*a* controls the entire superordinate apparatus 51. The CPU 71*a* controls the action of the superordinate apparatus 71 by using the control program in the ROM 71*b* and/or the HDD 71*d*.

The ROM 71*b*, the RAM 71*c*, and the HDD 71*d* store data. The ROM 71*b* and/or the HDD 71*d* previously store the control program for controlling the CPU 71*a*. The RAM 71*c* is used as the work memory of the CPU 71*a*.

The external interface 71*e* controls communication with devices external to the image forming apparatus 100. The external interface 71*e* can control the communication using TCP/IP (Transmission Control Protocol/Internet Protocol).

The control information interface 71*f* controls the communication of the control information data. The control information interface 71*f* can control communication corresponding to the PCI Express (Peripheral Component Interconnect Bus Express).

The imaged data interface 71*g* controls the communication of the printing image data. The image data interface 71*g* can control the communication corresponding to the PCI Express in case that high-speed transfer is required. The image data interface 71*g* includes plural channels corresponding to each color of the printing image data.

The superordinate apparatus 71 of the controlling unit 70 according to this embodiment receives the printing job data from the host apparatus by the external interface 71*e*, then the superordinate apparatus 71 stores the printing job data to the HDD 71*d* using the CPU 71*a*. The superordinate apparatus 71 reads the printing job data from the HDD 71*d* using the CPU 71*a*. Furthermore, the superordinate apparatus 71 produces the plural raster image data of each color (Yellow (Y), Cyan (C), Magenta (M), and Black (B)), then the superorinate apparatus 71 stores each color of the raster image data to the RAM 71*c*. At this time, the superordinate apparatus 71 (controlling unit 70) can produce each color raster image data by rendering the PDL (Page Description Language) as the RIP processing, then the superordinate apparatus 71 stores the data to the RAM 71*c*.

Next, the superordinaete apparatus compresses and encodes the each color raster image data and the superordinate apparatus 71 stores the data to the HDD 71*d*.

When the print controlling apparatus starts the print action, the superordinate apparatus 71 (CPU 71*a*) reads each raster image data from the HDD 71*d*, then the superordinate apparatus 71 decodes each raster image data and stores, to the RAM 71*c*, each raster image data which is decoded. Next, the superordinate apparatus 71 reads each color raster image data from the RAM 71*c*, then the superordinate apparatus 71 outputs each color raster image data to the printer control apparatus 72 via each channel of the image data interface 71*g*. The superordinate apparatus 71 can output the printing image data to the printer control apparatus 72 via plural data lines 7OLD (7OLD-Y, 7OLD-C, 7OLD-M, and 7OLD-K) in FIG. 8, corresponding to the colors.

The superordinate apparatus 71 receives and sends the control information data to the printer control apparatus 72 via the control information interface 71*f* (control lines 70LC) corresponding to the progression of the printing action.

Furthermore, when the printer control apparatus starts the post processing, the superordinate apparatus 71 according to this embodiment reads the encoded post-processing liquid image data from the HDD by the CPU 71*a*. The superordinate apparatus 71 outputs to the printer control apparatus 72 via the data line 70LD-P (FIG. 10)

The Printer Control Apparatus

The printer control apparatus 72 of the controlling unit 70 according an embodiment is an apparatus for controlling the action of forming an image on the printing medium based on the printing image data and the control information data.

Figure 10:
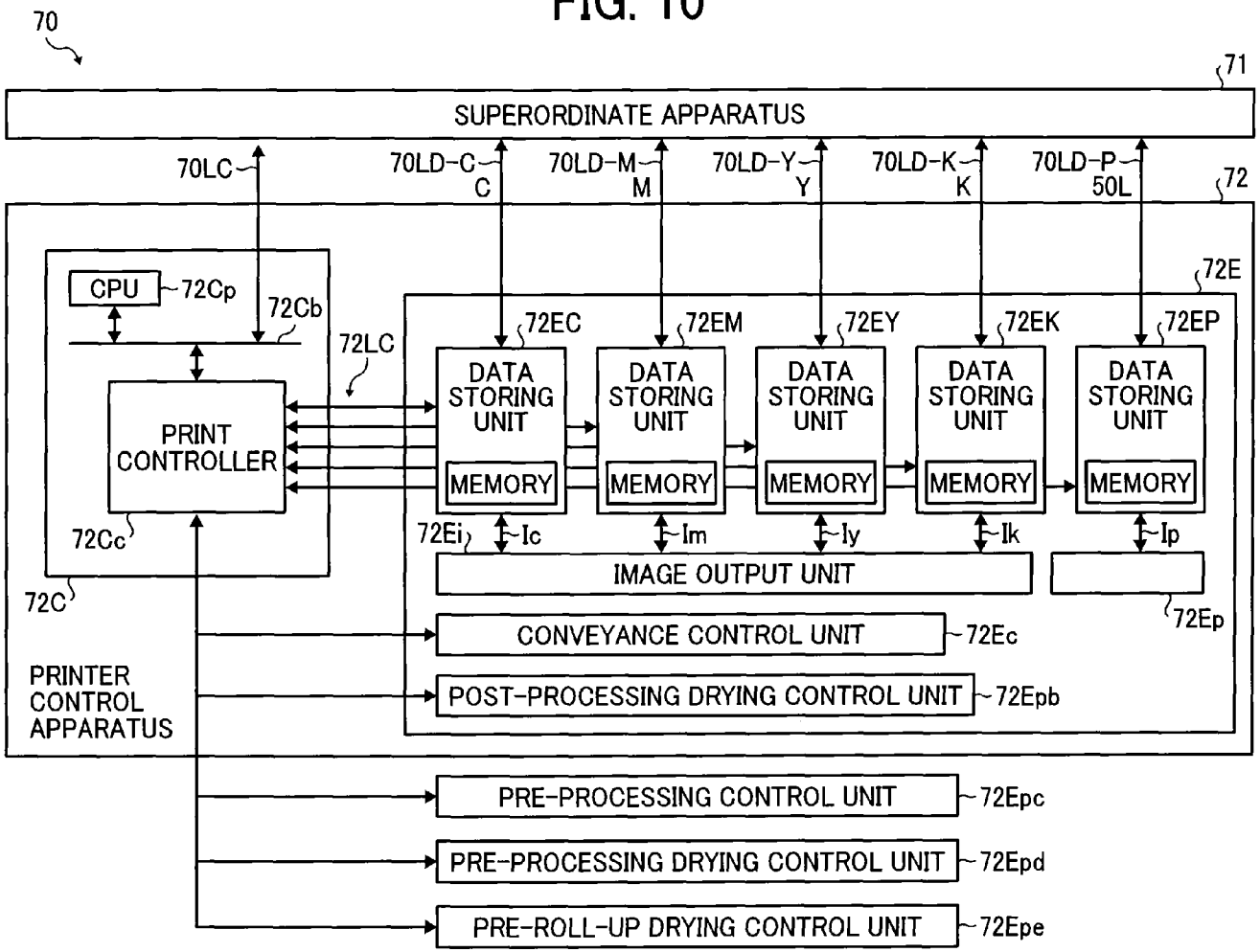
FIG. 10 is a functional block diagram showing an example of functions of the controlling unit.

As shown in FIG. 10, the printer control apparatus 72 of this embodiment includes the printer controller 72C and the printer engine 72E.

The printer controller 72C controls the action of the printer engine 72E. The printer controller 72C receives and sends the control information data, etc. to the superordinate apparatus 71 via the control line 70LC. The printer controller 72C receives and sends the control information data, etc. to the printer engine 72E via the control line 72LC. This enables the printer controller 72C to write the various printing conditions that are included the control information data to the register of a print control unit 72Cc, and store the printing conditions. The printer controller 72C can control the printer engine 72E based on the control information data, and print corresponding to the printing job data (control information data).

As shown in FIG. 10, the printer controller 72C of this embodiment includes a CPU 72Cp and a print control unit 72Cc. The CPU 72Cp and the print control unit 72Cc are connected via a bus 72Cb in the printer controller 72C. The bus 72Cb is connected to the control lines 70LC via a communication interface.

The CPU 72Cp controls the action of the entire printer control apparatus 72 using a control program stored in a ROM. The print control unit 72Cc receives and sends the command or the status information to the printer engine 72E based on the control information data that is received from the superordinate apparatus 71. This enables print control unit 72Cc to control the action of the printer engine 72E.

The printer engine 72E controls the action of forming an image on the printing medium based on the printing image data that is received from the superordinate apparatus 71 and the control information data that is received from the printer controller 72C. The printer engine 72E controls the action of the post-processing based on the printing image data (post-processing liquid image data) that is received from the superordinate apparatus 71 and the control information data (post-processing control data) that is received from the printer controller 72C.

As shown in FIG. 10, the printer engine 72E is connected to the plural data lines 7OLD (7OLD-Y, 7OLD-C, 7OLD-M, 70LD-K, and 70LP-P). The printer engine 72E receives the printing image data from the superordinate apparatus 71 via the plural data lines (7OLD-C) or the like. This enables the printer engine 72E to control the action of forming image data and performing the post-processing based on the printing image data that is received.

As shown in FIG. 10, the printer engine 72E of this embodiment includes plural data storing units 72EC, 72EM, 72EY, 72EK, and 72EP. The printer engine 72E includes an image output unit 72Ei which receives data from the data storing unit 72C etc., and a conveyance control unit 72EC that controls the conveying of the printing medium. Furthermore, the printer engine 72E of this embodiment includes a post-processing liquid output unit 72Ep, which receives the post-processing liquid image data from the data storing unit 72EP, and a post-processing drying control unit 72Epb, which controls the drying unit 30 (FIG. 1).

Additionally, the printer engine 72E may include a pre-processing control unit 72Epc, a pre-processing drying control unit 72Epd, and pre-roll-up drying control unit 72Epe.

The configuration of the data storing unit 72EC will be explained with reference to FIG. 10. Additionally, the configuration of the other data storing units 72EM, 72EY, 72EK, and 72EP will be omitted since they are similar to the configuration of the data storing unit 72EC.

Figure 11:
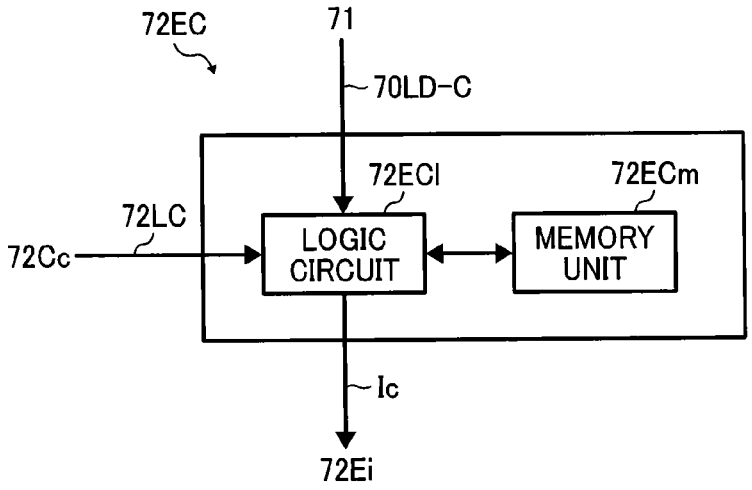
FIG. 11 is a functional block diagram showing an example of functions of a data management unit in the controlling unit.

As shown in FIG. 11, the data storing unit 72EC includes a logic circuit 72EC1 and a memory unit 72ECm. The data storing unit 72EC (the logic circuit 72ECI) is connected to the superordinate apparatus 71 via the data line 70LD-C. The data storing unit 72EC (the logic circuit 72ECI) is connected to the printer controller 72C (print control unit 72Cc) via the control line 72LC.

The logic circuit 72EC1 stores the printing image data to the memory unit 72ECm, which is outputted from the superordinate apparatus 71, based on the control signal, which is outputted from the printer controller 72C (print control unit 72Cc). Based on the control signal that is outputted from the printer controller (print control unit 72Cc), the logic circuit 72EC1 reads the printing image data Ic (FIG. 7) from the memory unit 72ECm corresponding to cyan (C), and outputs to the image output unit 72Ei. Additionally, the logic circuit 72EC1 (data storing unit 72EP) outputs the post-processing liquid image data Ip (FIG. 7) to the post-processing liquid output unit 72Ep.

The memory unit 72ECm can have a capacity that is able to store the image data of three pages or more. The three pages printing image data includes printing image data corresponding to the page that is receiving from the superordinate apparatus 71, and printing image data corresponding to the page that is sending to the image output unit 72Ei, and printing image data corresponding to the next sending page.

Additionally, the data storing unit 72EC may use a hardware logical circuit that is configured by the combination of plural logical circuits. This enables the data storing unit 72EC to perform the process at a higher speed. The data storing unit 72EC may decide a process to perform by logical determination based on the control signal of the bit sequence, for example.

The configuration of the image output unit 72Ei will be described with reference to FIG. 12. Additionally, the configuration of the post-processing liquid output unit 72Ep will be omitted as it is similar to the configuration of the image output unit 72Ei.

Figure 12:
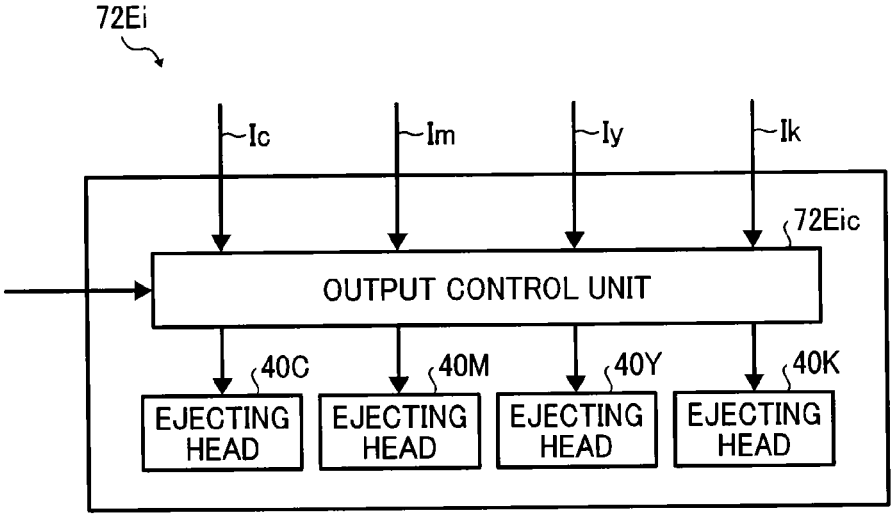
FIG. 12 is a functional block diagram showing an example of functions of an image output unit in the controlling unit.

As shown in FIG. 12 the image output unit 72Ei includes the output control unit 72Eic. The output control unit 72Eic outputs each printing image data to each ejecting head 40C, 40M, 40Y, and 40K (FIG. 3) corresponding to the color of the printing image data. This enables the output control unit 72Eic to control the action of the ejecting head 40C etc., based on the printing image data.

Specifically, the output control unit 72Eic individually controls the plural ejecting heads 40C, 40M, 40Y, and 40K. The output control unit 72Eic may simultaneously control the plural ejecting heads 40C, 40M, 40Y, and 40K, based on the printing image data (for example, Ic in FIG. 12). Furthermore, the output control unit 72Eic may control the ejecting head 40C, etc. based on the control signal that is inputted from a control apparatus. The output control unit 72Eic may control the ejecting head 40C, etc. based on the operation input of the user.

Accordingly, the printer control apparatus 72 inputs to the plural ejecting heads 40C, etc. the printing image data that is outputted from the superordinate apparatus, by using the data storing unit 72EC and the output control unit 72Eic. At this time, the printer control apparatus 72 can individually control each color printing image data. The printer control apparatus 72 can change the configuration of the printer engine 72E corresponding to the number of colors of the printing image data (C, M, Y, and K or K only) or the number of ejecting heads. That is, the printer control apparatus 72 in the image forming apparatus 100 according to this embodiment can reduce the cost and downsize the apparatus by mounting only the data storing unit 72EC that is needed and the ejecting head 40C that is needed.

For example, in case of forming the full-color image using C, M, Y, and K, the printer control apparatus 72 in the image forming apparatus 100 according to this embodiment can have all of the data storing units 72EC, etc. This enables the printer control apparatus 72 in the image forming apparatus 100 to connect to the ejecting heads 40C, etc. each output from the data storing units 72EC, etc. by the output control unit 72Eic.

For example, in case of forming the image using K only, the printer control apparatus 72 in the image forming apparatus 100 can have one data storing unit 72EK and one ejecting head 40K, giving priority to the cost. This enables the printer control apparatus in the image forming apparatus 100 to connect to the ejecting head 40K the output from the data storing unit 72EK by the output control unit 72Eic.

Furthermore, for example, in case of forming the image by K only, the printer control apparatus 72 in the image forming apparatus 100 can have one data storing unit 72EK and four ejecting heads giving priority to the speed of printing.

This enables the printer control apparatus 72 in the image forming apparatus 100 to connect the output from the data storing unit 72EK to each of the four ejecting heads by the output control unit 72Eic.

In this case, the printer control apparatus 72 in the image forming apparatus 100 can form an image at a speed four times the speed of using one ejecting head, by forming one color (K) using four ejecting heads.

Controlling the Amount of Applying of the Pre-Processing Liquid, Controlling the Dry Strength In this embodiment, the pre-processing control unit 72Epc of the controlling unit controls the applied amount of the pre-processing liquid based on the resolution of an image formed on the printing medium, and the pre-processing dry control unit 72Epd of the controlling unit controls the dry strength based on the resolution of an image formed on the printing medium.

The diameter of ink and the ease of drying change based on the resolution of an image formed on the printing medium. For example, when a low resolution image is formed, the diameter of an ink dot is large compared to when a high-resolution image is formed, and ink dots are difficult to dry because an ink dot has a large volume relative to surface area. Because the printing speed is high compared to when the high-resolution image is formed and ink dots are difficult to dry and penetrate, the bleeding of the image can easily occur.

Because of changing the necessary applied amount of the pre-processing liquid based on the resolution of an image formed on the printing medium, the controlling unit 70 of the image forming apparatus 100 improves quality of an image and reduces the bleeding by applying the right amount of the pre-processing liquid corresponding to the resolution.

Furthermore, the controlling unit 70 of the image processing unit 100 according to this embodiment can prevent the contraction of the printing medium by preventing over drying of the pre-processing liquid, and can prevent the degrading of quality of the image by preventing under drying of the pre-processing liquid, by controlling the dry strength of the pre-processing liquid drying unit 31 based on the resolution of an image to be printed. That is, the image forming apparatus 100 according to this embodiment can improve the image quality (printing quality).

The speed of conveying the printing medium is set to slow by the controlling unit 70 of the image forming apparatus 100, because a number of the dots that are formed by the image forming unit 40 is increased when a high resolution image is formed. As shown in FIG. 1, the time of passing through the drying unit is long when the speed of conveying the printing medium is slow, because the drying unit 30 and the image forming apparatus 40 are arranged in the same conveyance line. Accordingly, the drying unit 30 of the image processing unit 100 according to this embodiment can prevent the contraction of the printing medium by preventing over drying of the pre-processing liquid, by controlling the dry strength of the pre-processing liquid drying unit 31 based on the resolution of an image to be printed.

The print control unit 72Cc receives the resolution of the image from the superordinate apparatus 71.

The amount to be applied of the pre-processing liquid may be stored in association with the resolution, and the amount to be applied of the pre-processing liquid may be read when printing. The amount to be applied of the pre-processing liquid may be determined based on the operation input of the user.

The pre-processing liquid 20 using the roll coating method can adjust (control) the amount to be applied of the pre-processing liquid by changing (controlling) the nip pressure or the rotation speed of the applying roller 23 and/or the platen roller 24.

The drying strength may be stored in association with the resolution, and the drying strength may be read when printing. The drying strength may be determined based on the operation input of the user.

The drying unit 30 according to present embodiment is not limited to the above example.

Figure 13:
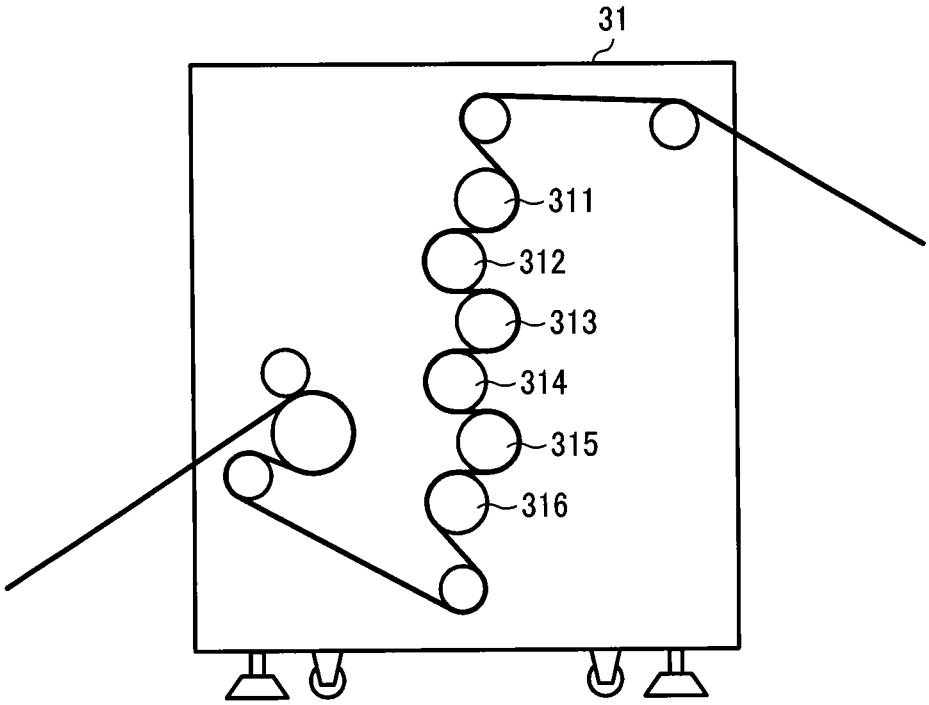
FIG. 13 is a schematic configuration view showing an example of a drying unit of an image forming apparatus.

As shown in FIG. 13, the drying unit 30 of this embodiment uses plural heating rollers 311, 312, 313, 314, 315, and 316.

The drying unit lowers the temperature of the heating roller 311 (312, etc), when the drying unit lowers the drying strength. For example, the drying unit 30 lowers the temperature when using ink that has a low penetrability, and raises the temperature when using ink that has a high penetrability. The drying unit 30 heats the heating unit 311 (or 312, or the like) from 40 degree C. to 80 degrees C., for example.

Furthermore, the drying unit 31 may control the drying strength by controlling the number of heating rollers that are used, so that the heating roller 311 and the heating roller 312 are heated, and the other heating rollers are not heated. Additionally, the drying unit 30 can control the drying strength by controlling both the temperature of the heating rollers and the number of rollers that are used, and can control the temperature of the heating rollers or the number of the heating rollers that are used separately.

Accordingly, the controlling unit 70 can increase the applied amount of the pre-processing liquid and the drying strength according to a decrease in the resolution of an image.

The controlling unit 70 can decrease the applied amount of the pre-processing liquid and the drying strength according to an increase in the resolution of an image.

This enables the controlling unit 70 of the image forming apparatus 100 to improve quality of an image and reduces the bleeding by applying the right amount of the pre-processing liquid corresponding to the resolution. Furthermore, the controlling unit 70 can prevent the contraction of the printing medium by preventing over drying of the pre-processing liquid, and can prevent the degrading of quality of the image by preventing under drying of the pre-processing liquid.

The controlling unit 70 can control further based on type of the printing medium.

The type of the printing medium includes the penetrability and/or the glossiness and/or the thickness of the printing medium. The type of the printing medium is not only the class, such as recycled paper, good quality paper, and heavy paper, but may be a trade name and/or a manufacturer's name.

In case that the type of the printing medium is heavy paper, the controlling unit 70 can increase the applied amount of the pre-processing liquid and the drying strength. In case of heavy paper, the absorbed amount is high. In case that the absorbed amount is high, the controlling unit 70 increases the applied amount of the pre-processing liquid. So, when the amount is increased, the controlling unit 70 raises the drying strength because of the difficulty in drying.

In case the type of the printing medium is high penetrability paper, the controlling unit 70 can increase the applied amount of the pre-processing liquid and the drying strength. In case the penetrability is high, the controlling unit 70 increases the applied amount of the pre-processing liquid. So, when the amount is increased, the controlling unit 70 increases the drying strength because of the difficulty in drying.

Accordingly, the image forming apparatus 100 can apply the appropriate amount of the pre-processing liquid, and can use the most appropriate drying condition of the printing medium before the image forming process, by controlling the pre-processing unit and the drying unit based on the resolution and type of the printing medium. This further enables the controlling unit 70 of the image forming apparatus 100 to improve the quality of an image and reduces the bleeding by applying the right amount of the pre-processing liquid corresponding to the resolution. Furthermore, the controlling unit 70 can further prevent the contraction of the printing medium by preventing over drying of the pre-processing liquid, and can prevent the degrading of quality of the image by preventing under drying of the pre-processing liquid.

The controlling unit 70 can store an amount to be applied of the pre-processing liquid and the drying strength corresponding to the resolution and the type of the printing medium. The controlling unit 70 can refer to the amount to be applied of the pre-processing liquid and the drying strength corresponding to the inputted resolution and the inputted type of the printing medium. Then, the controlling unit 70 can control the amount to be applied of the pre-processing and the drying strength based on input data.

The type of the printing medium can be inputted to the image forming apparatus 100 by a user. Specifically, the image forming apparatus 100 may receive the type of the printing medium from the operation input of the user using the UI (User Interface) or the like. In that case, the superordinate apparatus 71 can send control information data to the printer control apparatus 72 corresponding to the inputted information, and the printer control apparatus 72 can control the pre-processing control unit 72Epc and the pre-processing dry control unit 72Epd based on the control information data. The printer control unit 72 may have an external input device. In that case, the printer control unit 72 may receive the type of printing medium from the external input device.

The controlling unit 70 can increase the drying strength of the drying unit 30 by increasing the applied amount of the pre-processing liquid. The controlling unit 70 can decrease the drying strength of the drying unit 30 by decreasing the applied amount of the pre-processing liquid. This enables the controlling unit 70 of the image forming apparatus 100 to improve the quality of an image and reduces the bleeding and the contraction of the printing medium by preventing over drying of the pre-processing liquid, and can prevent the degrading of quality of the image, by controlling the most appropriate drying condition of the printing medium on which the pre-processing liquid was applied. This enables the image forming unit 40 to stably form an image. In some instances, this enables the post-processing unit 50 to stably apply (eject) the post-processing liquid.

In another embodiment, an image forming method of an image forming apparatus according will be explained.

The image forming apparatus of this embodiment can use the image forming apparatus 100 described above.

A configuration of the image forming apparatus of this embodiment is shown in FIGS. 1 to 6.

As shown in FIGS. 1 to 6, a description of the configuration of the image forming apparatus will be omitted because it is similar to the image forming apparatus described above.

A configuration of a controlling unit 70 of the image forming apparatus 100 according to this embodiment is shown in FIGS. 7 to 12.

As shown in FIGS. 7 to 12, a description of the configuration of the controlling unit 70 of the image forming apparatus 100 according to this embodiment will be omitted because it is similar to the controlling unit 70 described above.

The operation of forming an image by the image forming apparatus 100 according to this embodiment will be described with reference to FIGS. 14 and 15.

Figure 14:
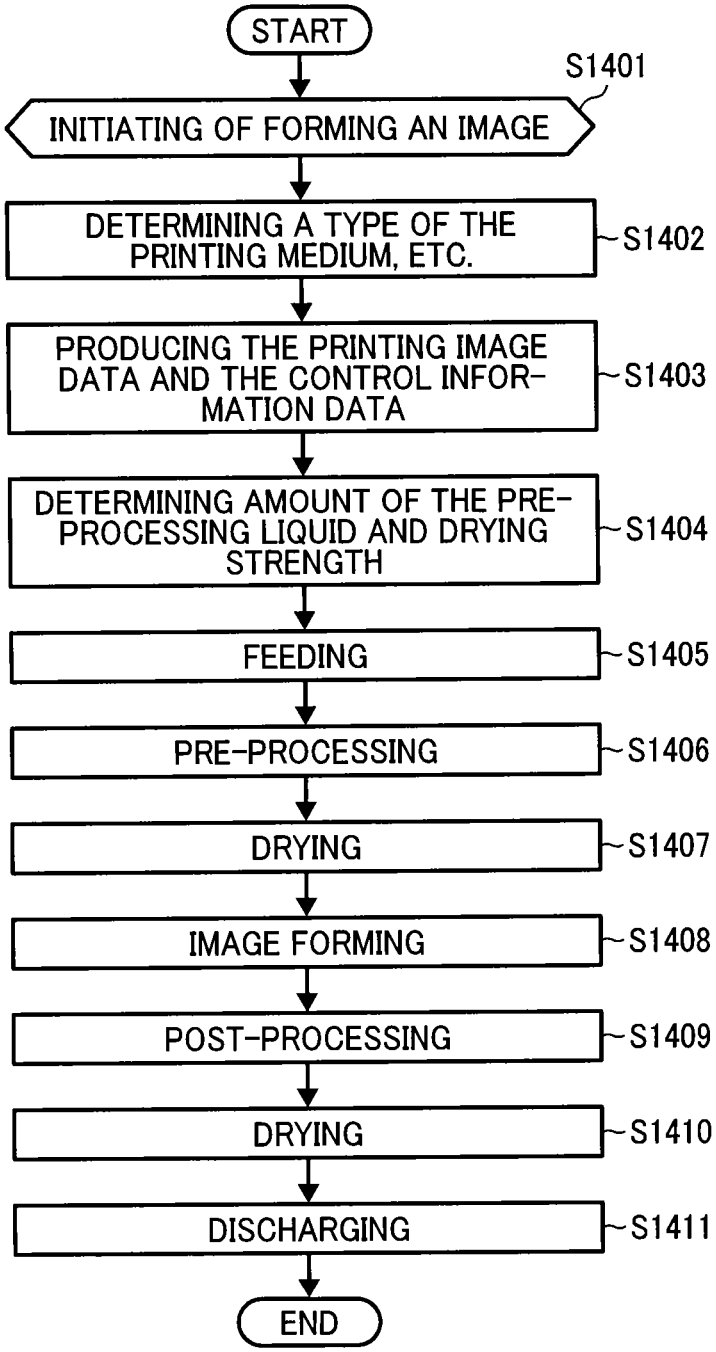
FIG. 14 is a flowchart showing an image forming method.

As shown in FIG. 14, the image forming apparatus 100 according to this embodiment, in step S1401, initiates forming an image, based on printing job data that is inputted from a device external to the image forming apparatus 100. The image forming apparatus 100 stores the printing job data, which is inputted to the HDD 71*d* of the superordinate apparatus 71.

Then, in step S1402, the image forming apparatus 100 determines the type of the printing medium by the controlling unit 70, and stores (sets) the determined type of printing medium to the HDD 71*d* of the superordinate apparatus 71.

At this time, the controlling unit 70 may store the information of the printing medium, including (a physical property value of the printing medium (a material, a thickness, a basis weight of the paper, or the like). The controlling unit 70 may store the type of the printing medium related to the pre-stored type of the printing medium in the HDD 71*d* of the superordinate apparatus 71. This enables the controlling unit 70 to read the type of the printing medium by using the related type. Additionally, the image forming apparatus 100 can pre-store the type of the printing medium to the HDD 71*d* of the superordinate apparatus based on the operation input of the user. Additionally, when the image forming apparatus 100 does not use the type of the printing apparatus as a parameter of control, the image forming apparatus 100 does not need to perform step S1402.

Then, in step S1403, the image forming apparatus 100 produces the printing image data and the control information data, or the like by the superordinate apparatus 71 of the controlling unit 70. Specifically, the superordinate apparatus 71 of the controlling unit 70 produces the printing job data and the control information data based on at least the resolution of the image in the printing job data, which is stored in the HDD 71*d*, or the like.

Then, in step S1404, the image forming apparatus 100 calculates the amount of the pre-processing liquid (the amount to be applied of the liquid in this embodiment), and the drying strength (pre-processing liquid drying strength) by the controlling unit 70.

Specifically, the controlling unit 70 calculates the amount to be applied of the pre-processing liquid 20L by the pre-processing unit 20 and the drying strength of the drying unit 30 based on at least the resolution of the image. The controlling unit 70 can calculate the amount to be applied of the pre-processing liquid 20L and the drying strength by further using the type of printing medium. When the resolution of the forming image is high, the controlling unit 70 can reduce the amount to be applied of the pre-processing liquid 20L. When the resolution of the forming image is low, the controlling unit 70 can raise the amount to be applied of the pre-processing liquid 20L.

Furthermore, when the resolution of the forming image is high, the controlling unit 70 can reduce the drying strength by the drying unit 30. When the resolution of the forming image is low, the controlling unit 70 can increase the drying strength by the drying unit 30.

That is, the controlling unit 70 can calculate an amount to be applied of the pre-processing liquid 20L based on the resolution of the formed image. This enables the controlling unit 70 of the image forming apparatus 100 to improve the quality of an image and reduce the bleeding and the contraction of the printing medium by preventing over drying of the pre-processing liquid, and can prevent the degrading of the quality of the image, by controlling the most appropriate drying condition of the printing medium on which the pre-processing liquid was apply applied. This enables the image forming unit 40 to stably form an image.

In case of ejecting the post-processing liquid, the controlling unit 70 can calculate an amount of ejecting (applying) of the post-processing liquid in step S1404. The controlling unit 70 can calculate the amount of ejecting (applying) of the post-processing liquid based on resolution of an image, type of the printing medium, and the amount of applying the pre-processing liquid.

This enables the image forming apparatus 100 to improve the abrasion resistance by controlling the amount of ejecting (applying) of the post-processing liquid 50L.

Additionally, the controlling unit 70 can set the amount to be applied of the pre-processing liquid 20L to 1.5 g/m2 or more, when increasing the amount to be applied of the pre-processing liquid 20L. The controlling unit 70 can set the amount to be applied of the post-processing liquid 50L to 1.2 g/m2 or more, when increasing the amount to be applied of the post-processing liquid 50L. Alternatively, the controlling unit 70 can set the amount to be applied of the pre-processing liquid 20L to less than 1.5 g/m2, when reducing the amount to be applied of the pre-processing liquid 20L. The controlling unit 70 can set the amount to be applied of the post-processing liquid 50L to less than 1.2 g/m2, when reducing the amount to be applied of the post-processing liquid 50L. The controlling unit 70 doesn't need to apply and eject, when reducing the amount to be applied of the pre-processing 20L and the amount of ejecting of the post-processing liquid 50L. Furthermore, the controlling unit 70 may change the amount to be applied of the pre-processing liquid 20L and the amount of ejecting of the post-processing liquid 50L, corresponding to a physical property value of the printing medium or the like.

The image forming apparatus 100 performs step S1405 after calculating the amount of the pre-processing liquid 20L and the drying strength (and the amount of the post-processing liquid 50L in some instances).

Then, in step S1405, the image forming apparatus 100 feeds the printing medium to the pre-processing unit 20 by using the sheet feeding unit 10 (FIG. 1). Additionally, the image forming apparatus 100 may initiate step S1405 soon after the initiation of step S1401. The image forming apparatus 100 performs step S1406 after initiating the feeding.

In step S1406, the image forming apparatus 100 performs the pre-processing by using the pre-processing unit 20 (FIG. 2). Specifically, the pre-processing unit 20 controls the nip pressure based on the amount to be applied of the pre-processing liquid 20L, which is calculated in step S1404 by using the pressure controller 25, and controls (changes) the amount to be applied of the pre-processing liquid 20L (the thickness of the liquid film, etc.). Additionally, the pre-processing unit 20 may control the amount to be applied of the pre-processing liquid 20L by changing the rotation speed of the applying roller 23 (FIG. 2). This enables the image forming apparatus 100 to reduce the bleeding of the formed image by controlling the amount to be applied of the pre-processing liquid 20L.

Figure 15:
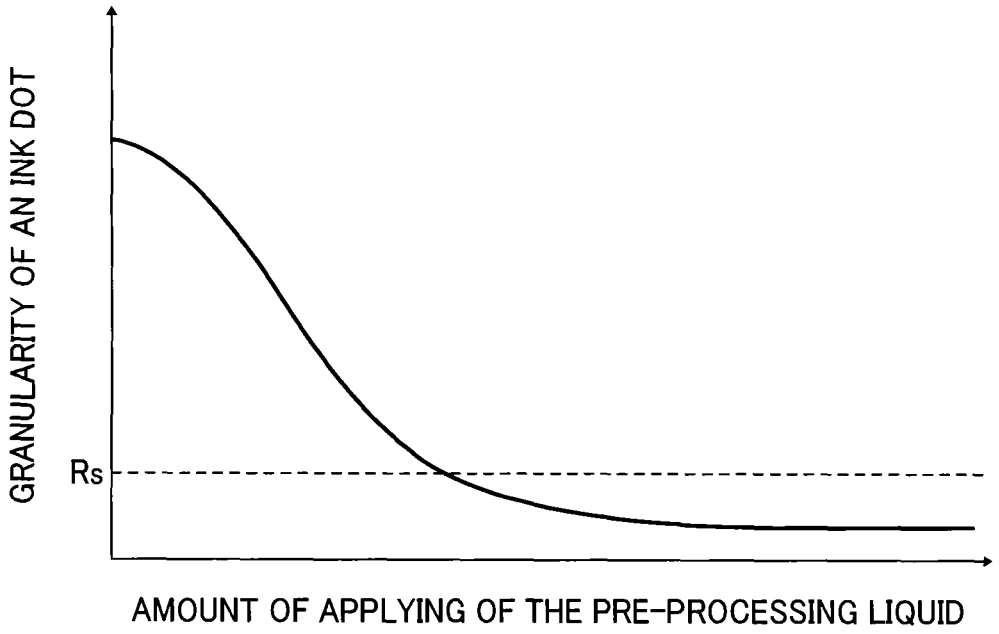
FIG. 15 is an illustration showing a relationship between the granularity of an image and the coating amount of pre-processing liquid.

As shown in FIG. 15, the image forming apparatus 100 can make the granularity of an ink dot to be small, by raising the amount to be applied of the pre-processing liquid 20L. That is, in the image forming apparatus 100, the granularity of ink dots can be less than a predetermined granularity Rs, by increasing the applied amount of the pre-processing liquid 20L. The predetermined granularity Rs can be the granularity of the difficulty to bleed an ink on the printing medium. The predetermined granularity Rs can be determined in an experiment or by numerical calculations. Then, the image forming apparatus 100 feeds the printing medium to the drying unit 30 (the pre-processing liquid drying unit 31 in FIG. 1).

In step S1407, the image forming apparatus 100 dries the printing medium by using the pre-processing liquid drying unit 31 (FIG. 1). The pre-processing liquid drying unit 31 dries the printing medium based on the pre-processing liquid drying strength, which was determined in step S1404. Specifically, the pre-processing drying unit 31 dries the printing medium based on at least the resolution of an image that is formed on the printing medium. The pre-processing drying unit 31 can dry the printing medium further using the type of the printing medium.

As shown in FIG. 13, the drying unit 30 (the pre-processing drying unit 31) can control the drying strength by controlling both the temperature of the heating roller and the number of rollers that are used, and can control the temperature of the heating roller or the number of the heating rollers that are used separately. The method of drying of the drying unit 30 (the pre-processing drying unit 31) is not limited to this method.

Then, the image forming apparatus 100 feeds the printing medium to the image forming unit 40 (FIGS. 1, 4, and 5).

In step S1408, as an image forming step, the image forming apparatus 100 forms an image on a surface of the printing medium by using the image forming unit 40, based on the printing image data that was produced (in step S1403). The image forming unit 40 may form an image by further using the resolution of the forming image and the type of the printing medium. The image forming unit 40 can control the action of the image forming by controlling the voltage applied to the piezoelectric element 45P (the pressure generating device 45 in FIGS. 6 and 7)

Then, the image forming apparatus 100 feeds the printing medium to the post-processing unit 50 (FIG. 1). Additionally, when the post-processing is not performed, the image forming apparatus does not perform step S1409, and performs step S1410. In this case, the image forming apparatus does not need to perform step S1410.

In step S1409, as a post-processing step, the image forming apparatus 100 treats the printing medium by using the post-processing unit 50.

Specifically, the post-processing unit 50 ejects (deposits) the post-processing liquid 50L onto a specify area in the area of forming an image of the printing medium, based on the post-processing liquid image data (in step S1403) and the amount of ejecting of the post-processing liquid that was calculated (in step S1404). The post-processing unit 50 can control the amount of ejecting of the post-processing liquid 50L on the printing medium by using the post-processing liquid output unit 72Ep of the controlling unit 70, based on the post-processing liquid image data.

Then, the image forming apparatus 100 feeds the printing medium to the drying unit 30 (the post-processing liquid drying unit 32 in FIG. 1).

Additionally, when the post-processing is not performed, the image forming apparatus performs step S1410, because the drying unit 30 (post-processing liquid, drying unit) dries not only the post-processing liquid but also dries the image that was formed in the image forming step. In this case, the image forming apparatus does not need to perform step S1410.

In step S1410, the image forming apparatus 100 dries the printing medium by using the post-processing liquid drying unit 32 (heating roller). The post-processing liquid drying unit 32 dries the printing medium based on the post-processing liquid drying strength, which was determined in step S1406. Specifically, the post-processing drying unit 31 dries the printing medium based on at least resolution of an image that is formed on the printing medium. The post-processing drying unit 31 can dry the printing medium further using the type of the printing medium, the amount to be applied of the pre-processing liquid (and the amount of ejecting (applying) of the post-processing liquid in some instances).

Then, in step S1411, the image forming apparatus 100 discharges the printing medium by using the sheet discharging unit 60 (FIG. 1).

Then the image forming apparatus 100 completes the image forming operation.

Accordingly, the image forming apparatus 100 according to this embodiment can obtain the same effect as the image forming apparatus 100 in the above described embodiments.

The foregoing description of the embodiments has been presented for the purpose of illustration; it is not intended to be exhaustive or to limit the inventions to the precise forms disclosed. Persons skilled in the relevant art can appreciate that many modifications and variations are possible in light of the above teachings. It is therefore intended that the scope of the inventions be limited not by this detailed description, but rather by the claims appended hereto.

The invention claimed is:

1. An image forming apparatus, comprising:

an image forming device that ejects droplets onto a printing medium, and forms an image on a surface of the printing medium;

a pre-processing device that applies a pre-processing liquid to the surface of the printing medium before the image forming device forms the image; and a dryer that dries the printing medium on which the pre-processing liquid was applied, wherein when the image formed on the printing medium has a first resolution, the dryer dries the printing medium using a drying strength that is weaker than when the image formed on the printing medium has a second resolution, the first resolution being higher than the second resolution.

2. The image forming apparatus as in claim 1, wherein when the image formed on the printing medium has the first resolution, the pre-processing device applies a smaller amount of the pre-processing liquid than when the image has the second resolution.

3. The image forming apparatus as in claim 1, wherein the pre-processing device is further configured to determine an amount of the pre-processing liquid, and the dryer is further configured to determine the drying strength based on a type of the printing medium.

4. The image forming apparatus as in claim 1, wherein when an amount of the pre-processing liquid applied is a first amount, the dryer dries the printing medium with a drying strength that is stronger than when the amount of the pre-processing liquid is a second amount, the first amount being larger than the second amount.

5. The image forming apparatus as in claim 1, wherein when an amount of the pre-processing liquid applied is a first amount, the dryer dries the printing medium with a drying strength that is weaker than when the amount of the pre-processing liquid is a second amount, the first amount being smaller than the second amount.

6. An image forming method, comprising:

applying a pre-processing liquid to a surface of a printing medium;

forming an image on the surface of the printing medium on which the pre-processing liquid was applied; and drying the printing medium on which the pre-processing liquid was applied, wherein the drying step includes when the image formed on the printing medium has a first resolution, drying the printing medium using a drying strength that is weaker than when the image formed on the printing medium has a second resolution, the first resolution being higher than the second resolution.

7. The image forming method as in claim 6, wherein the applying step includes determining an amount of the pre-processing liquid, and determining the drying strength based on a type of the printing medium.

8. An image forming apparatus, comprising:

an image forming device configured to eject droplets onto a printing medium, and to form an image on a surface of the printing medium;

a pre-processing device configured to apply a pre-processing liquid to the surface of the printing medium before the image forming device forms the image; and a dryer configured to dry the printing medium on which the pre-processing liquid was applied, wherein the pre-processing device is configured to apply an amount of the pre-processing liquid that is determined based on a resolution of the image formed on the printing medium, and the dryer is configured to dry the printing medium using a drying strength that is determined based on the resolution of the image formed on the printing medium, and the pre-processing device is configured to apply an increased amount of the pre-processing liquid, and the dryer is configured to dry the printing medium using an increased drying strength, as the resolution of the image formed on the printing medium decreases.

* * * * *